US006752334B2

(12) United States Patent
Augustin

(10) Patent No.: US 6,752,334 B2
(45) Date of Patent: Jun. 22, 2004

(54) FUEL INJECTOR AND METHOD FOR CONTROLLING FUEL FLOW

(75) Inventor: Ulrich Augustin, Blythewood, SC (US)

(73) Assignee: Siemens Diesel Systems Technology, Blythewood, SC (US)

( * ) Notice: Subject to any disclaimer, the term of this patent is extended or adjusted under 35 U.S.C. 154(b) by 181 days.

(21) Appl. No.: 09/903,686

(22) Filed: Jul. 13, 2001

(65) Prior Publication Data

US 2003/0010849 A1 Jan. 16, 2003

(51) Int. Cl.[7] ..... B05B 1/30; F02M 51/00; F02M 59/00

(52) U.S. Cl. ..... 239/585.5; 239/585.1; 239/585.4; 239/533.2; 239/533.3

(58) Field of Search ..... 239/585.5, 585.1, 239/585.3, 585.4, 88, 89, 90, 91, 533.2, 533.3, 533.8, 533.9, 124, 126, 127; 251/129.15, 129.21, 127

(56) References Cited

U.S. PATENT DOCUMENTS

| | | | | |
|---|---|---|---|---|
| 2,081,462 A | | 5/1937 | McClure | 277/42 |
| 2,144,861 A | | 1/1939 | Truxell, Jr. | 123/32 |
| 2,320,913 A | | 6/1943 | Crowell | 137/21 |
| 2,536,836 A | | 1/1951 | Bowling | 251/139 |
| 3,277,830 A | | 10/1966 | Kalert, Jr. et al. | 103/44 |
| 3,403,632 A | | 10/1968 | Hulsing | 103/154 |
| 3,474,861 A | | 10/1969 | Watkins | 166/224 |
| 3,982,693 A | | 9/1976 | Hulsing | 239/88 |
| 4,065,058 A | | 12/1977 | Knape et al. | 239/88 |
| 4,236,759 A | | 12/1980 | Lysenko | 303/6 A |
| 4,427,151 A | * | 1/1984 | Trenne | 239/87 |
| 4,538,576 A | | 9/1985 | Schneider | 123/446 |
| 4,550,875 A | | 11/1985 | Teerman et al. | 239/88 |
| 4,741,478 A | | 5/1988 | Teerman et al. | 239/88 |
| 4,856,713 A | | 8/1989 | Burnett | 239/113 |
| 5,189,877 A | | 3/1993 | Wells et al. | 60/293 |
| 5,199,860 A | | 4/1993 | Stegmaier | 417/566 |
| 5,328,094 A | | 7/1994 | Goetzke et al. | 239/88 |
| 5,485,957 A | | 1/1996 | Sturman | 239/88 |
| 5,797,427 A | | 8/1998 | Buescher | 137/533.17 |
| 6,029,902 A | | 2/2000 | Hickey et al. | 239/88 |
| 6,047,899 A | | 4/2000 | Graves | 239/90 |

* cited by examiner

*Primary Examiner*—Davis Hwu
(74) *Attorney, Agent, or Firm*—McGuireWoods LLP

(57) ABSTRACT

A fuel injector device having a blowback valve disposed in the injector body, the blowback valve having a first portion and a second portion, a fuel passage being disposed through the first and second portions, a closure member being disposed in the fuel passage and movable in a first direction and a second direction, the closure member permitting a predetermined volume of fuel flow in the second direction before the closure member moves to the second position. The invention also include a method to control the fuel flow through an injector by providing a body having a first portion and a second portion, a fuel passage extending through the portions and a closure member movable in the fuel passage between a first position and a second position, and the closure member permitting a predetermined volume of fuel to flow in one direction before the closure member moves to the second position. The predetermined volume of fuel is related to the displacement of the closure member of the blowback valve and the displacement of the needle assembly of the fuel injector between an injecting position and a non-injecting position.

22 Claims, 4 Drawing Sheets

FUEL INJECTOR AND METHOD FOR CONTROLLING FUEL FLOW

FIELD OF THE INVENTION

This invention is directed to a fuel injector and a method for controlling the flow of fuel.

BACKGROUND OF THE INVENTION

It is known to provide a conventional fuel injector with a check valve to prevent the back flow of fuel at the end of each injection event. However, the abrupt fuel flow termination causes wear on the valve member due to the rapid movement of the valve member against its seat. This rapid movement is believed to trap a volume of fuel in the injection nozzle, causing the nozzle to stay open. This movement is believed to slow down the closing rate of the nozzle while permitting entry of combustion gases. As a result, both the check valve and the nozzle are believed to wear out prematurely in the conventional fuel injector.

Thus, there is a strong need to overcome these and other problems associated with the conventional fuel injector.

SUMMARY OF THE INVENTION

Accordingly, the present invention is directed to controlling fuel flow in a fuel injector, and to overcoming the disadvantages of the conventional art.

The present invention provides an injector for metering fuel into a combustion chamber. The injector comprises a body having a first portion and a second portion, a fuel passage extending through the body, and a closure member movably in the fuel passage between a first position and a second position, the fuel passage having a first segment extending through the first portion and a second segment extending through the second portion. The first position of the closure member permits fuel flow in a first direction through the fuel passage and the second position prohibits fuel flow in a second direction opposite to the first direction. The closure member permits a predetermined volume of fuel flow in the second direction before the closure member moves to the second position. A needle assembly is movable between a first position and a second position, the predetermined volume of fuel being related to the displacement of the needle assembly between the first position and the second position of the needle assembly.

The present invention further provides a method to control fuel flow through a fuel injector in an internal combustion engine. The method comprises providing a body, providing a closure member movable in the fuel passage between a first position and a second position, permitting fuel flow in a first direction through the fuel passage when the closure member is in the first position, prohibiting fuel flow in a second direction opposite to the first direction when the closure member is in the second position, and permitting a predetermined volume of fuel flow in the second direction before the movement of the closure member to the second position. The body includes a fuel passage extending through the body, the fuel passage having a first segment extending through the first portion and a second segment extending through the second portion.

BRIEF DESCRIPTION OF THE DRAWINGS

The accompanying drawings, which are incorporated herein and constitute part of this specification, illustrate presently preferred embodiments of the invention, and, together with the general description given above and the detailed description given below, serve to explain features of the invention.

DETAILED DESCRIPTION OF THE PREFERRED EMBODIMENT

Figure 1:
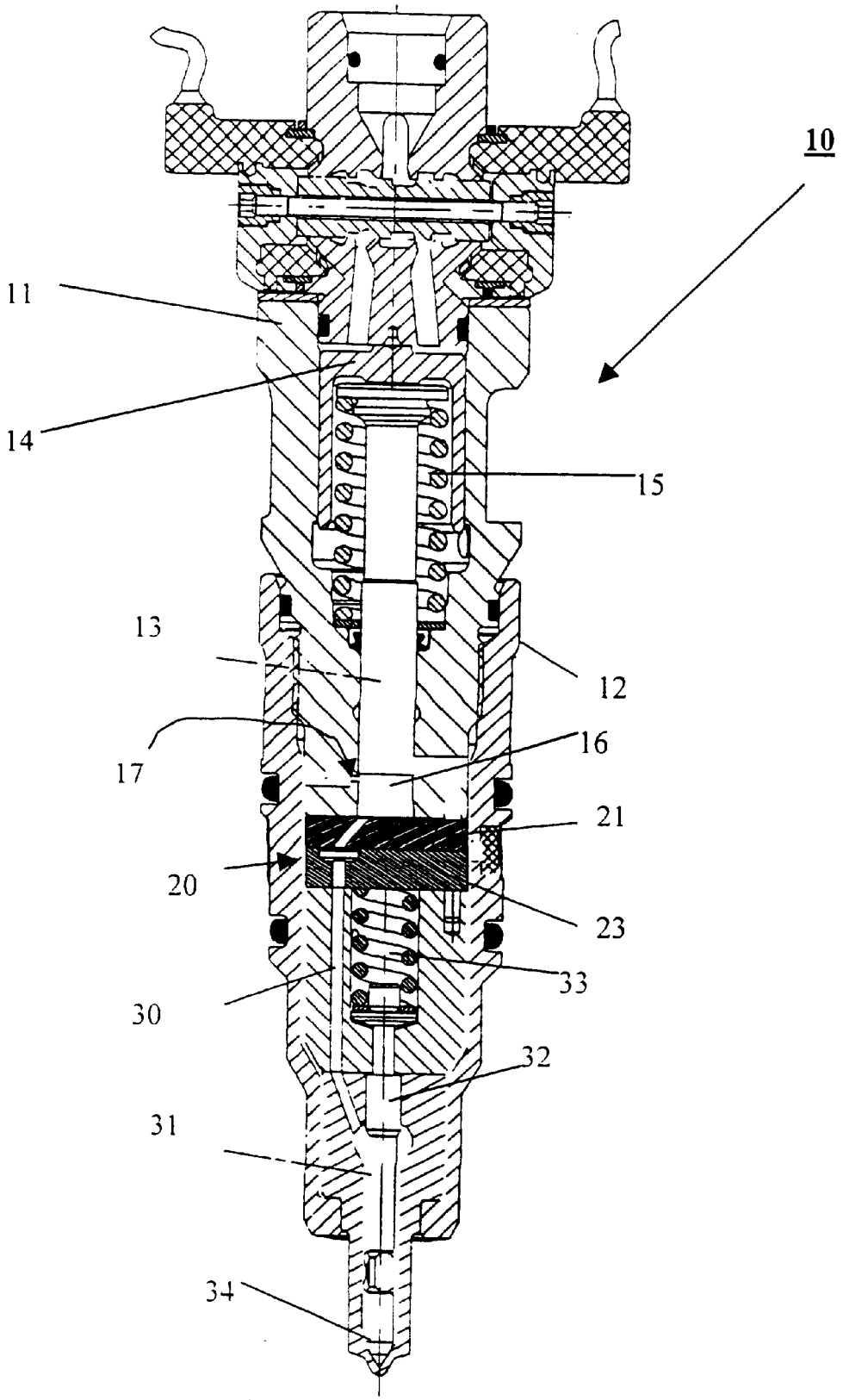
FIG. 1 is a cross-sectional view of the fuel-injector according to the present invention.

Referring to FIG. 1, a high-pressure fuel injector 10 is shown. Injector 10 has an upper injector body 11 coupled to a lower injector body 12. A plunger 13 is contained in the upper injector body 11. Plunger 13 is movable along the axis of upper injector body 11 by a piston 14. Piston 14 is actuated by hydraulic pressure. A resilient member 15, for example, a spring, biases the plunger against the hydraulic pressure.

A portion of plunger 13 reciprocates in a chamber 16. A volume that is bounded by the injector body 11 and a blowback valve 20 forms chamber 16. A fuel port 17 communicates fluidly with chamber 16, plunger 13 and blowback valve 20. Blowback valve 20 comprises of an upper disc 21 and a lower disc 22. A fuel passage 30*a*, in fluid communication with chamber 16, is formed in the upper disc 21. A stepped bore 23 is formed in the lower disc 22. The bore 23 also communicates fluidly with another fuel passage 30*b* that is in communication with the plunger chamber 31. It is believed that a constant pressure differential is maintained across the blowback valve 20 by having both fuel passages 30*a* and 30*b* with substantially the same cross-sectional area. Finally, the needle assembly 32 is biased in a closed position by a resilient element 33.

Figure 2:
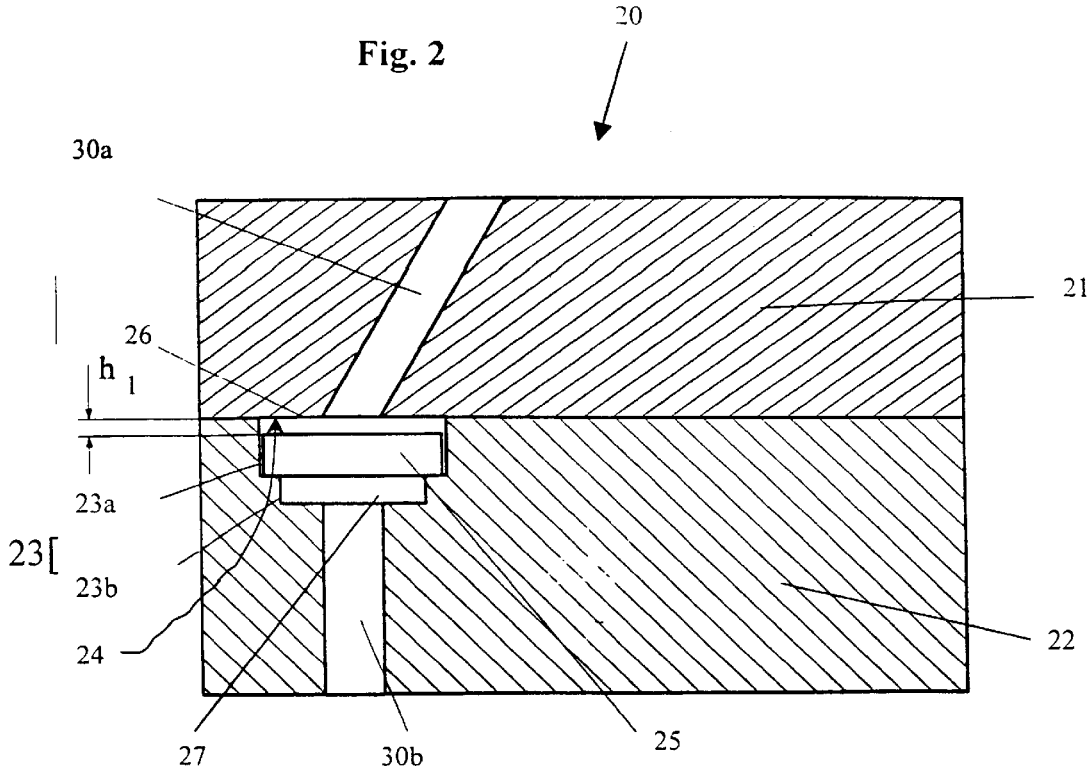
FIG. 2 is an enlarged cross-sectional view of the blowback valve shown in FIG. 1 in this invention.
Figure 3:
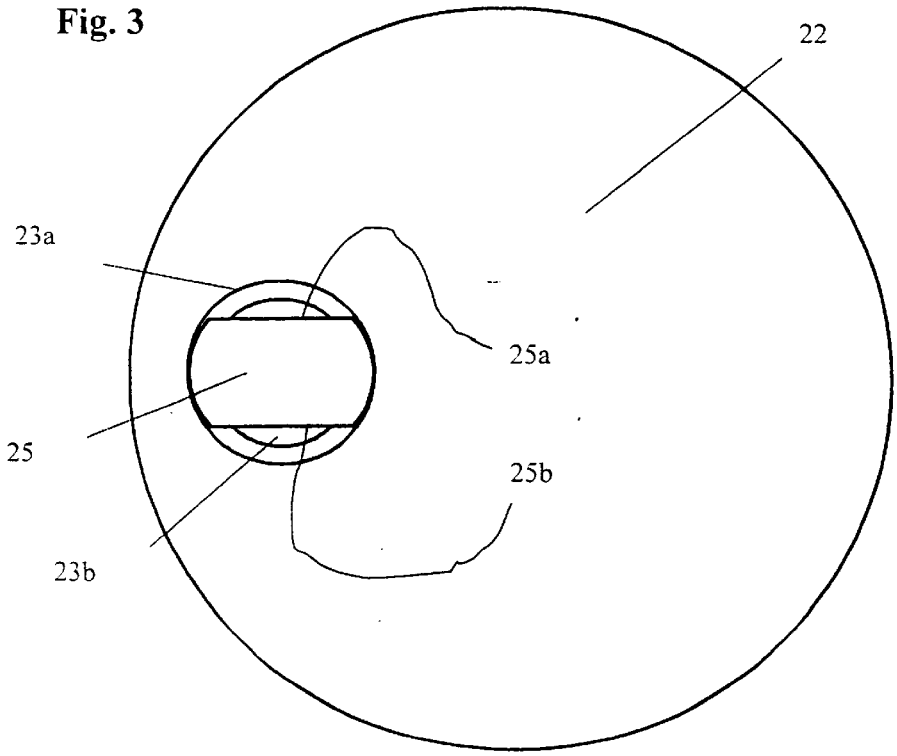
FIG. 3 is a top view of the blowback valve.

Details of the blowback valve 20 can be seen in FIG. 2. A fuel passage 30*a* is formed through the upper disc 21. A stepped bore 23 is comprised of a first chamber 26 with a first diameter and a second chamber 27 with a second diameter. The sealing seat surface 24 of the first chamber 26 is honed to a "super-finished" surface quality. The term "super finished" is used to indicate a surface roughness of about 1 to 3 $\mu$in (microinch or about 0.025 to 0.075 micrometer). The fuel passage 30*a* is connected to the second chamber 27. Disposed within the first chamber 26 is a sealing disc 25. The sealing disc 25 should be of a certain thickness such that there is a gap "h1" between the sealing disc 25 and the sealing surface 24 when the sealing disc 25 rests on the abutment between the first chamber 26 and the second chamber 27. The importance of the first diameter and the gap "h1" will be discussed later in conjunction with the operation of the injector.

The sealing disc 25 can be ovoid in shape except that two of its sides 25*a* and 25*b* can be parallel, thereby presenting a gap between the sealing disc 25 and the walls of the first chamber 26. Each of the sides of the sealing disc 25 is defined by an imaginary plane parallel to the axis of the disc 25 and intersecting with the sealing disc 25. As shown, the sum of the area defined by the gap between each side of the sealing disc 25 and the circumference of the second chamber 27 should be at least equal to the diameter of the fuel passage 30*a* and 30*b*. Preferably, the gap should be such that when the disc 25 is resting on the second chamber 27, no throttling or restriction is made to the fluid flow between passages 30*a* and 30*b*.

In operation, pressurized, hydraulic pressure acts on piston 14 when a fuel injection controller (not shown) commands injection of fuel. Piston 14 is moved along the axis of the injector. Plunger 13, being coupled to piston 14, is actuated once the force of spring 15 is overcome. Movement of the plunger 13 also closes the fuel port 17 at substantially the same time. Fluid pressure in chamber 16 therefore increases rapidly due to the compression of the plunger 13. The pressurized fuel in chamber 16 is then communicated from fuel passage 30*a*, to the blowback valve 20, to fuel passage 30*b* and to the fuel chamber 31. At a predetermined fuel pressure, needle assembly 32 is lifted upwardly against the resilient element 33 causing fuel to be injected from needle 34 into the combustion chamber of an engine (not shown).

At the end of an injection cycle, the piston 14 and the needle assembly 32 return to the position as shown in FIG. 1. At substantially the same instant, needle 34 starts to close, causing the remaining fuel in the needle chamber 31 and fuel passage 30*b* to increase in pressure. The increase in fuel pressure here is believed to cause the disc 25 to move towards the super-finished surface 24. The disc 25, however, can not move until a predetermined volume of fuel has been pushed back into the chamber 16. Where the volume of fuel being pushed back is greater than a predetermined volume, the nozzle chamber 31 experiences a large pressure drop. This pressure drop, on the next injection event, causes a lag between the desired injection and the actual injection event. On the other hand, if the volume of fuel being pushed back is less than a predetermined volume, the needle 34 remains open, thereby introducing combustion particulates and gases into the nozzle. Thus, the predetermined volume is the volume of fuel necessary to maintain an incipient nozzle chamber pressure while allowing the needle to remain closed. The predetermined volume of fuel is believed to be a volume of fuel sufficient to maintain a fill-pressure or an incipient injection pressure in the nozzle chamber 31. Accordingly, the volume of fuel permitted to flow back can be determined by the first diameter of the first chamber 26 and the distance "h1" at which sealing disc 25 has to travel before the back flow of fuel is terminated. Preferably, the volume of the chamber should be between 2 cubic-millimeter and 10 cubic-millimeter. It should be understood that for other types of fuel injection system that may employ higher hydraulic pressure or larger volume injectors, the diameter and stroke of the chamber will also have to be changed to ensure that a sufficient volume of fuel can be pumped back to permit a controlled closing of the needle valve, such that wear on the sealing surface or the needle valve is substantially reduced.

By allowing a predetermined volume of fuel to gradually flow back to chamber 16, needle 34, it is believed, can close against the combustion pressure and combustion particulates relatively quickly while slowing the movement of the sealing disc 25. The blowback valve described here is believed to have at least the following benefits: (1) reducing a premature wear of the blow-back valve 20 by the delayed movement of the sealing disc 25, and (2) permitting the rapid closing action of the needle 34 which reduces nozzle damage due to combustion gas, NOx emission and noise.

Figure 4:
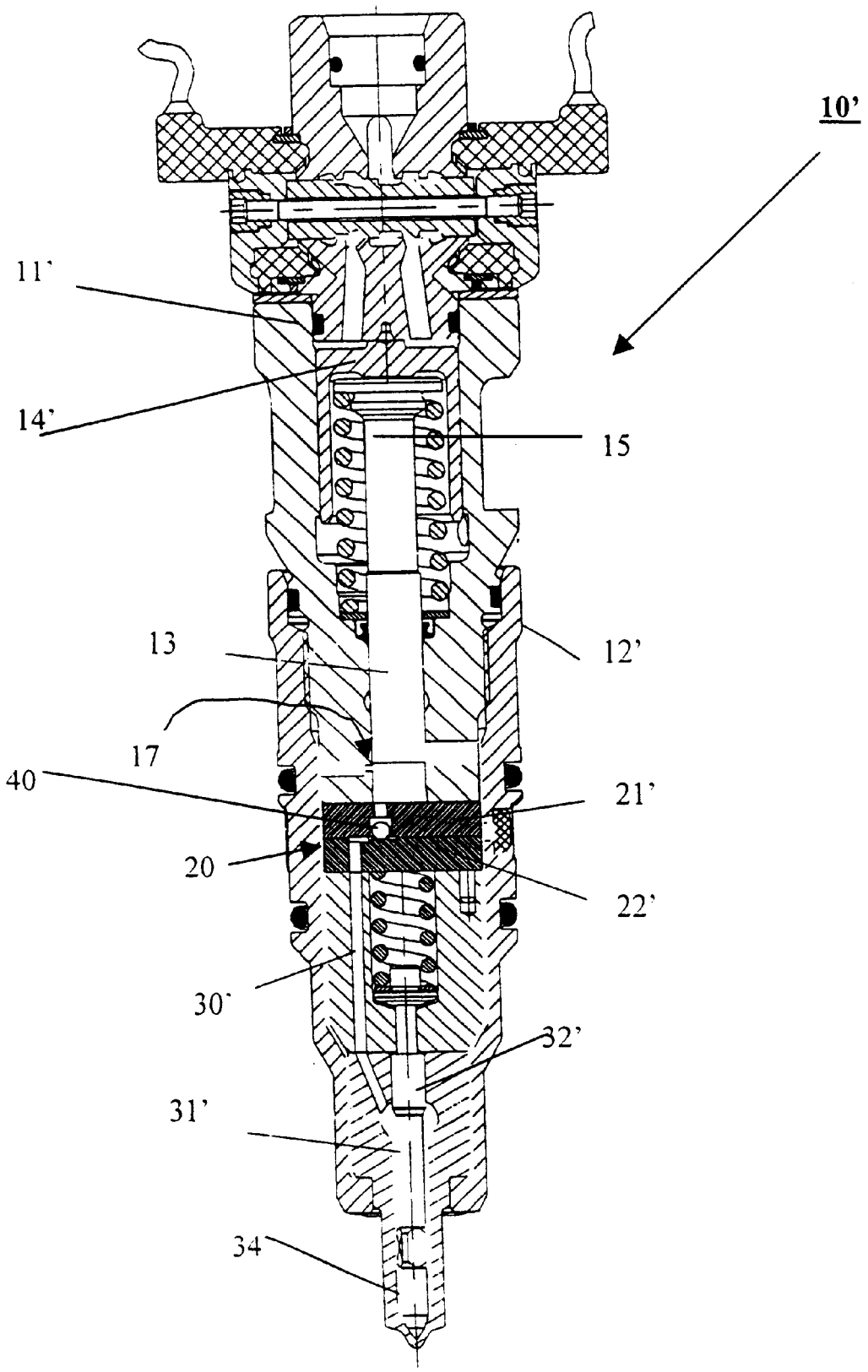
FIG. 4 is a cross-sectional view of another fuel injector according the present invention.

An alternative configuration is shown in FIG. 4. To maintain brevity. elements corresponding to those discussed with respect to FIG. 1 are labeled with the "prime" notation and will be discussed only as needed.

In FIG. 4, the blowback valve uses a spheroidal element 40 instead of a sealing disc 25. A fuel passage 30*a*' is connected to the chamber 16'. A chamber 41 is formed in first disc 21'. The chamber 41 is connected to a continued fuel passage 30*b*'.

Figure 5:
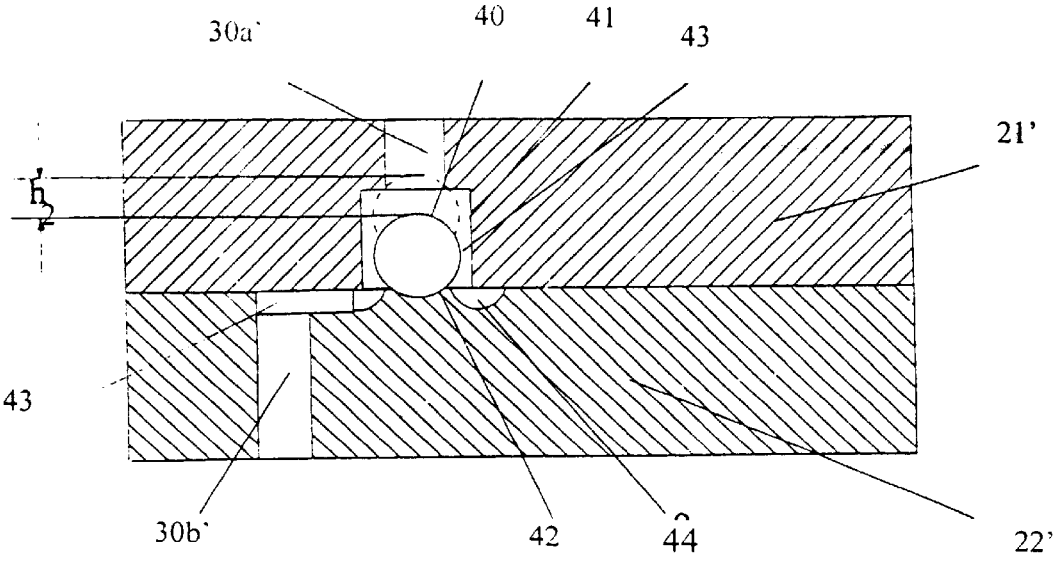
FIG. 5 is an enlarged cross-sectional view of the blowback valve shown in FIG. 4.
Figure 6:
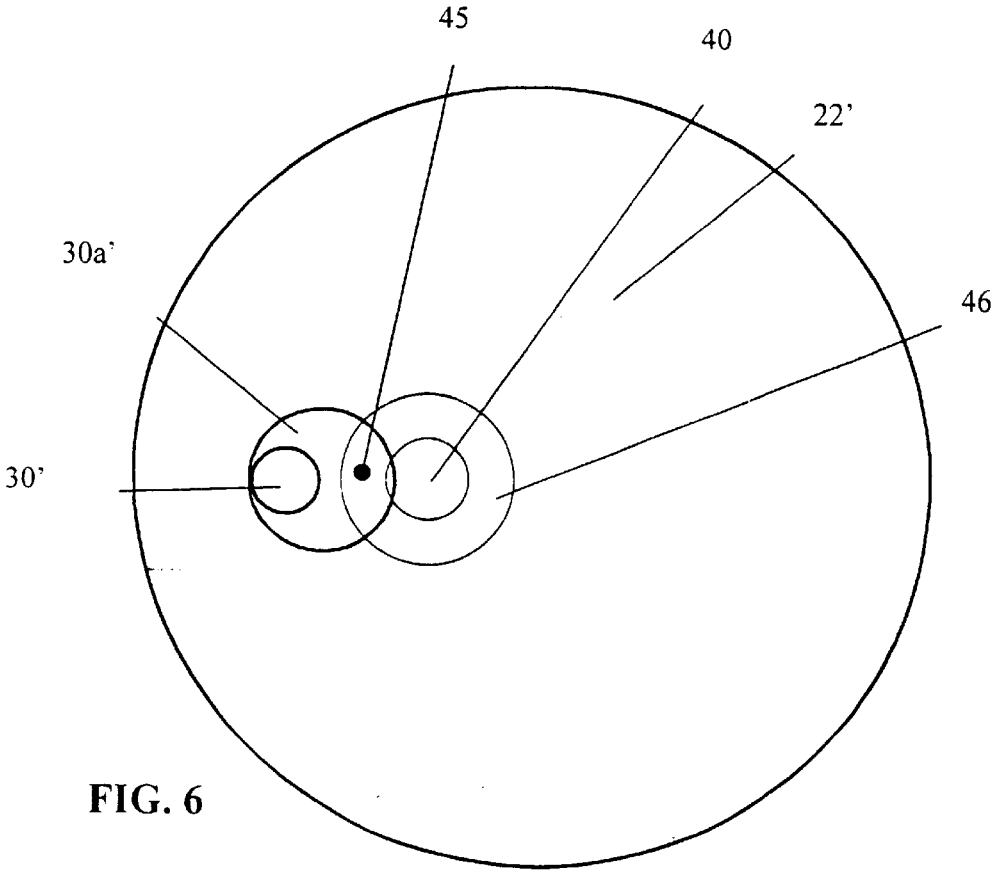
FIG. 6 is a top view of the blowback valve shown in FIG. 4.

Referring to FIG. 5, disposed in the chamber 41 is a spheroidal element 40. A second disc 22' is mated to the first disc. The second disc 22' has a spheroidal ball seat 42 formed therein. A shallow bore 43 is formed on the second disc 22'. The shallow bore 43 is connected to the fuel passage 30'. The shallow bore 43 is axially offset from the spheroidal ball seat 42. An annular groove 44 is formed around the spheroidal ball seat 42. To facilitate the flow of fuel, the annular groove 44 and the shallow bore 43 overlap each other in the shaded area 45. To maintain a consistent flow rate, the shaded area 45 should be at least the same as the cross sectional area of the fuel passage 30'. Moreover, the area defined by the chamber 41 and the spheroidal element 40 should be at least the same as the cross-sectional area of the fuel passage 30' to prevent any throttling or restriction of the fluid flow.

The operation of FIG. 4 is as follows. At the end of the injection cycle described above, the piston 14' and the plunger 13' return to the position as shown in FIG. 4. At substantially the same instant, the needle 34' starts to close, causing the remaining volume of fuel that is trapped in the nozzle chamber 31' and fuel passage 30*b*' to be pumped back toward the chamber 16'. This backflowing movement of fuel to the chamber 16 is believed to cause the spheroidal element 40 to move towards the stepped surface 41A. Spheroidal element 40 is prevented from slamming into the sealing surface 41A. because a predetermined volume of fuel back must be pumped back to chamber 16'. This, in turn, is believed to reduce wear on the sealing surface 41A.

Once the predetermined volume of fuel in both the passage line 30*b*' and the nozzle chamber 31' has been pumped out, needle 34' rapidly closes against the impinging combustion pressure. Preferably, the diameter of the chamber 41 and the distance "h2" at which the spheroidal element 40 has to travel before the fluid flow is terminated can determine the predetermined volume of fuel. Preferably, the predetermined volume can be between 2 cubic-millimeter and 10 cubic-millimeter. As an example, the distance h2 can be between 0.3 millimeter and 0.9 millimeter, and the diameter of the chamber 41 can be about 3 millimeter. It should be understood that for other types of fuel injection system that may employ higher hydraulic pressure or larger volume injectors, the diameter and stroke of the chamber will also have to be changed to ensure that a sufficient volume of fuel can be pumped back to permit a controlled closing of the needle valve, such that wear on the sealing surface or the needle valve is substantially reduced.

Since the blow-back valve 20' of this invention is believed to allow the needle 34' to rapidly close against combustion pressure while also preventing the spheroidal element 40 from slamming into its sealing surface, premature wear on the valve and the nozzle is believed to be reduced. Additionally, the rapid closing action of the needle 34', subsequent to the backflow of fuel, reduces noise, emission and ingress of combustion particulates.

Another benefit is believed to be gained by the use of the spheroidal ball seat 42. As the injection event is terminated, a very high-pressure pulse is formed in chamber 16'. This high-pressure pulse is communicated through the blowback valve 20' to the nozzle chamber 31'. By having the spheroidal ball seat 42 under the ball, the fuel trapped in this spheroidal ball seat 42 must be pumped out by the spheroidal element 40 as the pressure pulse impinges against the spheroidal element 40. The pressure pulse is therefore dampened, allowing the needle 34' to return substantially smoothly and generally quickly to its closed position instead of remaining generally open.

While the claimed invention has been disclosed with reference to certain preferred embodiments, numerous modifications, alterations, and changes to the described embodiments are possible without departing from the sphere and scope of the claimed invention, as defined in the appended claims. Accordingly, it is intended that the claimed invention not be limited to the described embodiments, but that it have the full scope defined by the language of the following claims, and equivalents thereof.

What is claimed is:

1. An injector for metering fuel into a combustion chamber, the injector comprising:

a body having a first portion and a second portion;

a chamber formed along the axis of the injector, the chamber confronting the first portion and coupled to the fuel passage;

a plunger reciprocally movable in the chamber;

a fuel passage extending through the body, the fuel passage having a first segment extending through the first portion and a second segment extending through the second portion;

a closure member movable in the fuel passage between a first position which exposes a flow area which is at least equal to a diameter of the fuel passage to avert throttling in the fuel passage between the first segment and the second segment, and a second position, the first position permitting fuel flow in a first direction through the fuel passage, the closure member permitting a predetermined volume of fuel flow in a second direction, oposite the first direction, before the closure member moves to the second position and prohibits fuel flow in the second direction, the chamber being fluid communication with the fuel passage; and a needle assembly in fluid communication with the fuel passage and movable between a first position and a second position, the predetermined volume of fuel relating at least to the displacement of the needle assembly between the first position and the second position of the needle assembly.

2. The injector as claimed in claim 1, wherein the second segment includes first part having a first cross-sectional size and a second part having a second cross-sectional size larger than the first cross-sectional size, and wherein the closure member is movable in the second part.

3. The injector as claimed in claim 2, wherein the fuel passage has a substantially constant cross-sectional size.

4. The injector as claimed in claim 3, wherein a cross sectional flow area between the closure member and the second part is at least equal to the cross sectional size of the fuel passage.

5. The injector as claimed in claim 1, wherein the predetermined volume of fuel flow is related to the product of the distance of the movement of the closure member and the cross-sectional area of the second part.

6. The injector as claimed in claim 1, wherein the closure member comprises a disc having a first surface substantially parallel to a second surface.

7. The injector as claimed in claim 6, a plane parallel to the axis of the disc and intersecting the disc defines the first surface and another plane parallel to the disc and intersecting the disc defines the second surface.

8. The injector as claimed in claim 1, wherein the closure member comprises a sphere having a radius of curvature.

9. The injector as claimed in claim 8, wherein the second portion comprises a seat.

10. The injector as claimed in claim 9, wherein the seat comprises a portion of a sphere having a radius of curvature substantially equal to the radius of curvature of the sphere.

11. The injector as claimed in claim 9, wherein the seat is adapted to be filled with fuel and the closure member is adapted to displace the fuel in the seat.

12. The injector as claimed in claim 1, wherein the first segment is oriented obliquely with respect to the second segment.

13. The injector as claimed in claim 1, wherein the closure member comprises a disc having a first surface substantially parallel to a second surface thereby creating a gap between the first surface and the second surface and a wall of the second segment of the fuel passage.

14. The injector as claimed in claim 1, wherein a volume of fluid to flow back is determined by the first segment having a first diameter and a distance of travel of the closure member to a sealing surface of the first segment.

15. An injector for metering fuel into a combustion chamber, the injector comprising:

a body having a first portion and a second portion: a chamber formed along the axis of the injector, the chamber confronting the first portion and coupled to the fuel passage, the second portion comprises a seat and an annular groove surrounding the seat;

a plunger reciprocally movable in the chamber;

a fuel passage extending through the body, the fuel passage having a first segment extending through the first portion and a second segment extending through the second portion, the annular groove being a part of the second segment;

a closure member movable in the fuel passage between a first position and a second position, the first position permitting fuel flow in a first direction through the fuel passage, the second position prohibiting fuel flow in a second direction opposite to the first direction, the closure member comprises a sphere having a radius of curvature and further permitting a predetermined volume of fuel flow in the second direction before the closure member moves to the second position, the chamber being fluid communication with the fuel passage; and a needle assembly in fluid communication with the fuel passage and movable between a first position and a second position, the predetermined volume of fuel relating at least to the displacement of the needle assembly between the first position and the second position of the needle assembly.

16. An injector for metering fuel into a combustion chamber, the injector comprising:

a body having a first portion and a second portion: a chamber formed along the axis of the injector, the chamber confronting the first portion and coupled to the fuel passage;

a plunger reciprocally movable in the chamber;

a fuel passage extending through the body, the fuel passage having a first segment extending through the first portion and a second segment extending through the second portion, the first segment being axially offset with respect to the second segment;

a closure member movable in the fuel passage between a first position and a second position, the first position permitting fuel flow in a first direction through the fuel passage, the second position prohibiting fuel flow in a second direction opposite to the first direction, the closure member permitting a predetermined volume of fuel flow in the second direction before the closure member moves to the second position, the chamber being fluid communication with the fuel passage; and a needle assembly in fluid communication with the fuel passage and movable between a first position and a second position, the predetermined volume of fuel relating at least to the displacement of the needle assembly between the first position and the second position of the needle assembly.

17. The injector as claimed in claim 16, wherein a shallow bore is formed in the second segment, the cross-sectional area of the shallow bore overlapping the cross sectional area of the annular groove.

18. The injector as claimed in claim 17, wherein the area defined by the overlapping cross-sectional areas is at least equal to the cross-sectional area of the fuel passage.

19. A method of controlling fuel flow through an injector for an internal combustion engine, the method comprising:

providing a body having a first portion and a second portion, a fuel passage extending through the body, the fuel passage having a first segment extending through the first portion and a second segment extending through the second portion, a closure member movably in the fuel passage between a first position and a second position, the closure member, when in the first position, creating a flow area at least equal to a diameter of the fuel passage to avert a throttling effect in the first segment and the second segment of the fuel passage, a needle assembly in fluid communication with the fuel passage and movable between non-injecting position and a fluid injecting position;

permitting fuel flow in a first direction through the closure member and the fuel passage;

prohibiting fuel flow in a second direction opposite to the first direction;

causing the needle assembly to move to a fluid-injecting position;

permitting the needle assembly to move to a non-injecting position; and permitting a predetermined volume of fuel flow in the second direction before the closure member moves to the second position.

20. The method as claimed in claim 19, wherein the second segment includes first part having a first cross-sectional size and a second part having a second cross-sectional size larger than the first cross-sectional size, and wherein the closure member is movable in the second part.

21. The method as claimed in claim 20, wherein the predetermined volume of fuel flow is defined by the product of the distance traveled by the closure member between the first and second position and the cross-sectional area of the second part.

22. The method as claimed in claim 20, wherein the predetermined volume of fuel flow is related to the displacement of the needle assembly movable between the non-injecting position and the fluid injecting position.

* * * * *

UNITED STATES PATENT AND TRADEMARK OFFICE

CERTIFICATE OF CORRECTION

PATENT NO. : 6,752,334 B2
DATED : June 22, 2004
INVENTOR(S) : Ulrich Augustin

It is certified that error appears in the above-identified patent and that said Letters Patent is hereby corrected as shown below:

Column 5,
Line 41, insert -- in -- before “fluid”.

Signed and Sealed this

Third Day of August, 2004

JON W. DUDAS
*Acting Director of the United States Patent and Trademark Office*